US009272718B2

(12) United States Patent
Huber, Jr. et al.

(10) Patent No.: US 9,272,718 B2
(45) Date of Patent: Mar. 1, 2016

(54) SLACK ADJUSTER ENVIRONMENTAL IMPROVEMENTS

(71) Applicant: NEW YORK AIR BRAKE, LLC, Watertown, NY (US)

(72) Inventors: Howard E. Huber, Jr., Black River, NY (US); Eric C. Wright, Evans Mills, NY (US); Jeffrey Sauter, Lowville, NY (US)

(73) Assignee: New York Air Brake, LLC, Watertown, NY (US)

( * ) Notice: Subject to any disclaimer, the term of this patent is extended or adjusted under 35 U.S.C. 154(b) by 0 days.

(21) Appl. No.: 14/463,133

(22) Filed: Aug. 19, 2014

(65) Prior Publication Data

US 2014/0353095 A1 Dec. 4, 2014

Related U.S. Application Data

(63) Continuation-in-part of application No. 14/180,903, filed on Feb. 14, 2014.

(60) Provisional application No. 61/764,230, filed on Feb. 13, 2013.

(51) Int. Cl.
*B61H 15/00* (2006.01)

(52) U.S. Cl.
CPC ..... *B61H 15/0028* (2013.01)

(58) Field of Classification Search
CPC ..... B60T 7/08; B60T 11/06; B60T 7/108; F16D 65/56; F16D 65/38; B61H 15/0028; B61H 15/00; B61H 15/0057
USPC ..... 188/197, 202, 196 D, 196 R
See application file for complete search history.

(56) References Cited

U.S. PATENT DOCUMENTS

| | | | | |
|---|---|---|---|---|
| 3,520,387 | A * | 7/1970 | Natschke | B61H 15/0057 188/196 D |
| 3,593,826 | A | 7/1971 | Sander | |
| 3,680,664 | A | 8/1972 | Farr | |
| 4,646,882 | A | 3/1987 | Holloway | |

(Continued)

FOREIGN PATENT DOCUMENTS

| | | | |
|---|---|---|---|
| EP | 0014417 | | 8/1980 |
| EP | 0042637 | A1 * | 12/1981 |
| EP | 0099007 | | 1/1984 |

(Continued)

OTHER PUBLICATIONS

International Search Report Form PCT/ISA/220, International Application No. PCT/US2014/049584, pp. 1-11, Dated Feb. 9, 2015.

*Primary Examiner* — Melanie Torres Williams
(74) *Attorney, Agent, or Firm* — David L. Nocilly; Bond Schoeneck & King, PLLC

(57) ABSTRACT

A slack adjuster that is protected against environmental contaminants via a series of holes positioned circumferentially around each end and covered by a sleeve having a slot is aligned with one of the series of holes while covering the remaining holes. The sleeve protects against infiltration of contaminants at the ends of the slack adjuster and allows any contaminants that do infiltrate the slack adjuster to be expelled through the aligned hole and slot. The central portion of the slack adjuster may also be protected by including a series of circumferential holes that are selectively covered by a sleeve having a drain positioned to align with the lowest holes while covering the remaining holes.

10 Claims, 7 Drawing Sheets

(56) References Cited

U.S. PATENT DOCUMENTS

| | | | | |
|---|---|---|---|---|
| 7,802,662 | B2 * | 9/2010 | Sommerfeld | B61H 13/24 188/197 |
| 8,696,208 | B1 * | 4/2014 | Everline | F16D 65/22 384/129 |

FOREIGN PATENT DOCUMENTS

| | | |
|---|---|---|
| EP | 0353796 | 2/1990 |
| EP | 0729873 | 9/1996 |
| EP | 0844161 | 5/1998 |
| WO | 2012112659 | 8/2012 |

* cited by examiner

SLACK ADJUSTER ENVIRONMENTAL IMPROVEMENTS

CROSS-REFERENCE TO RELATED APPLICATION

The present application is a continuation-in-part of U.S. application Ser. No. 14/180,903, filed on Feb. 14, 2014, which claimed priority to U.S. Provisional Application No. 61/764,230, filed on Feb. 13, 2013.

BACKGROUND OF THE INVENTION

1. Field of the Invention

The present invention relates to railroad braking system slack adjusters and, more particularly, to various improvements for protecting slack adjusters against environmental damage.

2. Description of the Related Art

Slack adjusters are provided in the brake rigging of railway vehicles to automatically adjust the slack in the brake rigging to maintain the brake cylinder piston rod travel within a specified distance. Brake cylinder piston rod travel is important for proper balancing of the fluid pressure in the brake cylinder so that all brakes on a train operate under the same conditions and timing and to ensure the substantially uniform braking forces are applied to each set of wheels on each car in the train. Because slack adjusters include a variety of moving parts and are exposed to the elements under a rail car, slack adjusters are exposed to numerous environmental contaminants, such as dust, dirt, and water, which can corrosion and even failure.

BRIEF SUMMARY OF THE INVENTION

The present invention comprises a slack adjuster that is better protected against environmental contaminants and resulting corrosion. The spring housing of the slack adjuster has a series of holes are positioned circumferentially around one end and a sleeve having a slot is positioned in covering relation to the first end of the spring housing so that the slot is aligned with one of the series of holes and the remaining holes are covered by the sleeve. The overtravel housing also includes a series of holes that extend circumferentially around one end and are covered by a second sleeve having a slot that is positioned so that the slot is aligned with one of the series of holes and the remaining holes are covered by the sleeve. The sleeve may be configured as a boot and may be fixedly attached to the spring housing by a clamp or by elasticity of the sleeve itself. The central portion of the slack adjuster may also be protected against contaminants by including a series of holes extending circumferentially around the coupler and clutch portion and are selectively covered by a sleeve having a drain that is positioned around the coupler so that the drain aligns with one of the series of holes and covers the remaining holes.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
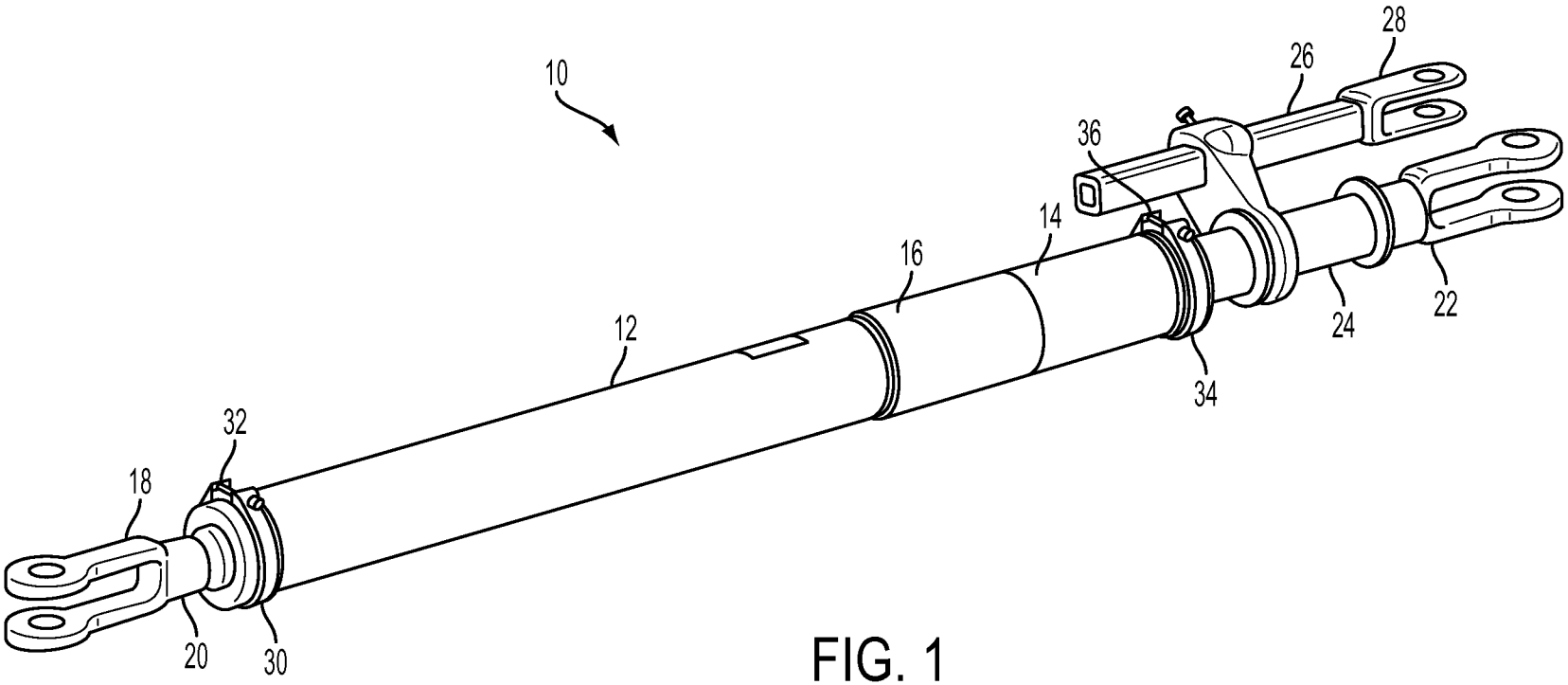
FIG. 1 is a perspective view of a slack adjuster according to the present invention.

Referring now to the drawings, wherein like reference numerals refer to like parts throughout, there is seen in FIG. 1 a slack adjuster 10 having various modifications to protect slack adjuster 10 against adverse environmental conditions. As seen in FIG. 1, adjuster 10 comprises a spring housing 12 coupled to an overtravel housing 14 via a body coupler 16. A first clevis 18 allows for the connection of a first rod 20 extending from one end of slack adjuster 10 to the fulcrum lever of a foundation type braking system. A second clevis 22 allows a second rod 24 extending from overtravel housing 14 of slack adjuster 10 to be connected the control lever of a foundation type braking system. A control rod 26 is positioned at the second end of slack adjuster 10 and includes a third clevis 28 for connecting control rod 26 to a different location on the control lever of a foundation type braking system. As with conventional slack adjusters known to those of skill in the art, slack adjuster 10 is extended and compressed by the opposing forces placed on first clevis 18 and second clevis 22 as well as control clevis 28 when the brake cylinder piston actuates the brakes. Slack adjuster 10 will change in length and, if appropriate, retain a new length to reset the relationship between the brake cylinder piston travel and the application of the brakes to compensate for wearing of the brake pads. As a result of the ongoing adjustment by slack adjuster 10, the brake cylinder piston travel will remain the same and an application of the brakes will provide a consistent level of braking over time despite wear to the brake pads.

Due to the various moving parts of slack adjuster 10, there are several areas where environmental contaminants may infiltrate into main body of slack adjuster 10, thereby causing damage over time, such as corrosion, and compromising the effectiveness of the operation of slack adjuster 10. As seen in FIG. 1, the present invention protects against infiltration of contaminants by positioning a first sleeve 30 and a first clamp 32 at the exposed end of spring housing 12 to provide for drainage and optionally provide for additional sealing. A second sleeve 34 and second clamp 36 are positioned on the exposed end of overtravel housing 14. Sleeves 30 and 34 may configured as boots that additionally cover the end of spring housing 12 and the end of overtravel housing 14 where first rod 20 and second rod 24 extend therefrom, respectively.

Figure 2:
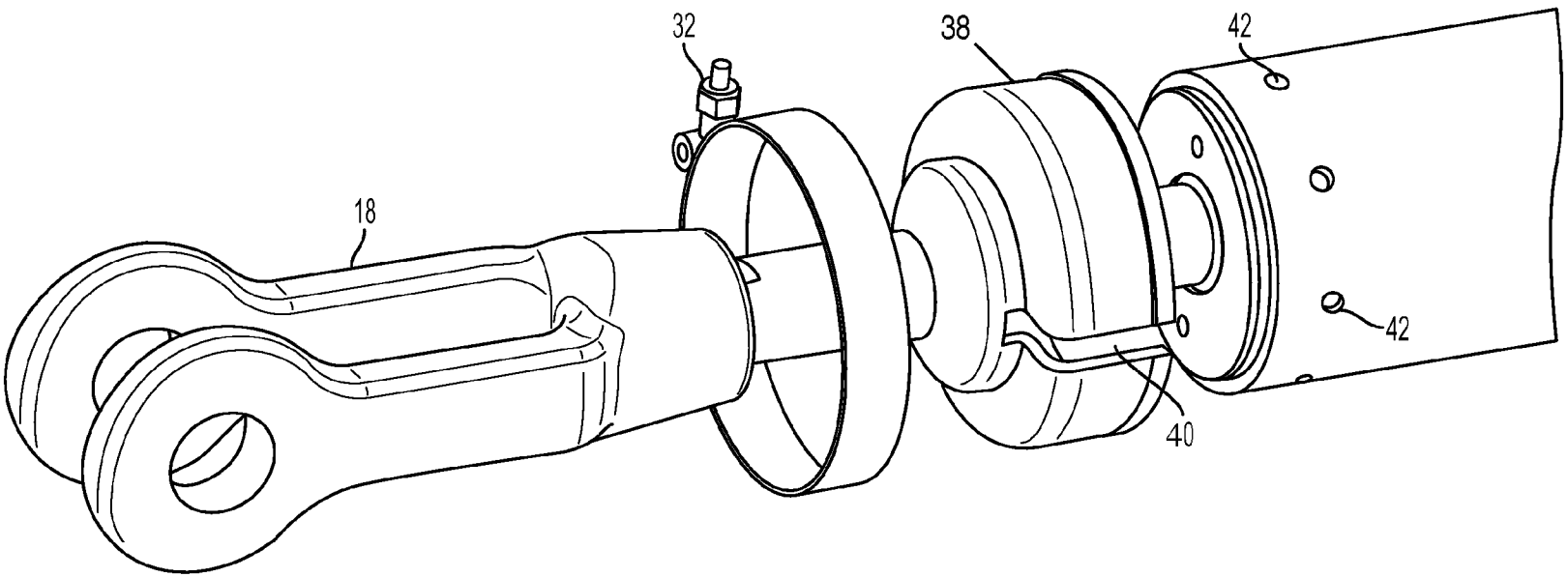
FIG. 2 is an exploded view of one end of a slack adjuster according to the present invention.

Referring to FIG. 2, sleeve 30 comprises an annular body 38 having a single drain slot 40 formed therethrough. A series of holes 42 are formed through the end of spring housing 12 and are circumferentially positioned about spring housing 12. Preferably, holes 42 are spaced equally about the end of spring housing 12. Regardless of how slack adjuster 10 is installed, one hole 42 is likely to be positioned near the bottom of spring housing 12 and thus capable of draining any moisture or other contaminants in spring housing 12. When slack adjuster 10 is installed, sleeve 30 may be positioned so that slot 40 aligns with whichever hole 42 is at the bottom after slack adjuster 10 is installed. The rest of annular body 38 seals the remaining holes 42 against ingress, thereby providing a single drainage point in the optimum location regardless of how slack adjuster 10 is installed. It should be recognized that sleeve 30 may be repositioned at any time after installation to expose a different hole 42 should the original hole 42 exposed by drain slot 40 no longer offer the best drainage point.

Figure 3:
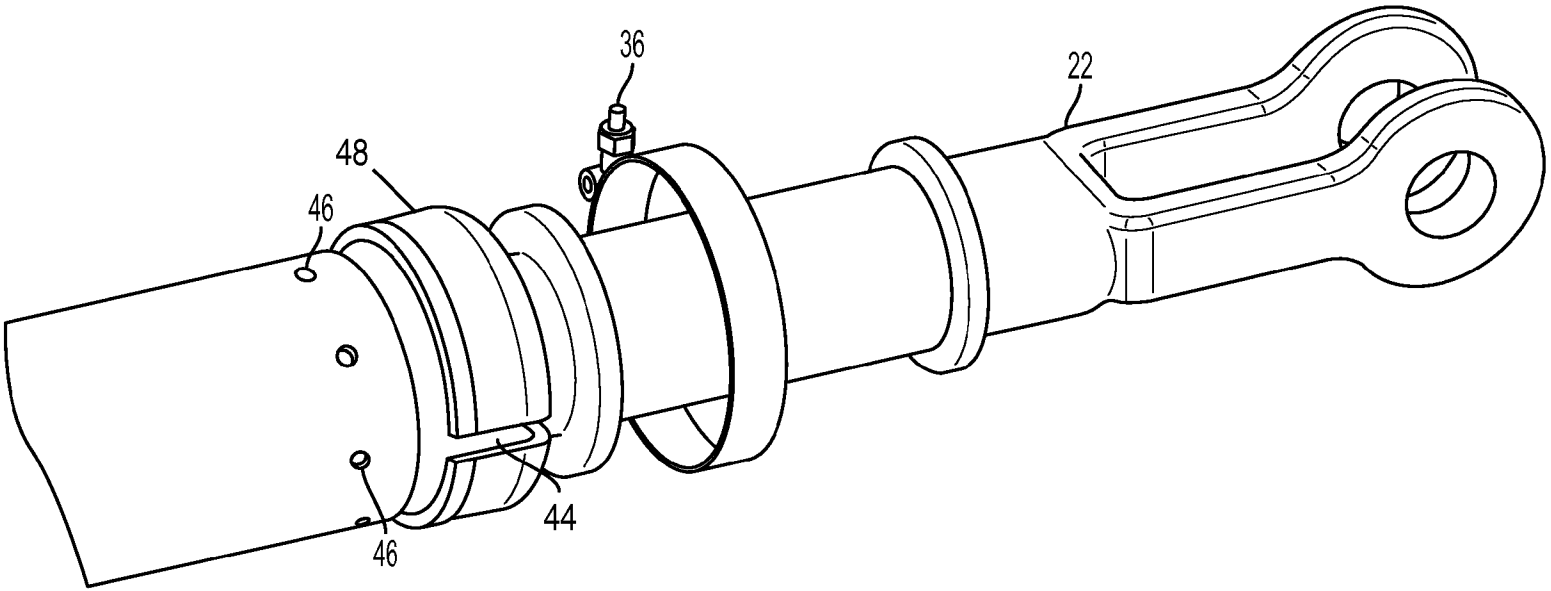
FIG. 3 is an exploded view of another end of a slack adjuster according to the present invention.

Referring to FIG. 3, second sleeve 34 and clamp 36 may be used to similarly seal overtravel housing 14 against ingress of contaminants and to provide a drainage point via a slot 44 formed in the annular body 48 of sleeve 34. Slot 44 is aligned with any one of a series of holes 46 formed through overtravel housing 14 and spaces circumferentially about the end of overtravel housing. As seen in FIGS. 2 and 3, the particular shape of sleeve 30 or sleeve 34 may be designed to closely seal against the particular structure of spring housing 12 or overtravel housing 14 depending on the particular design of slack adjuster 10.

Figure 4:
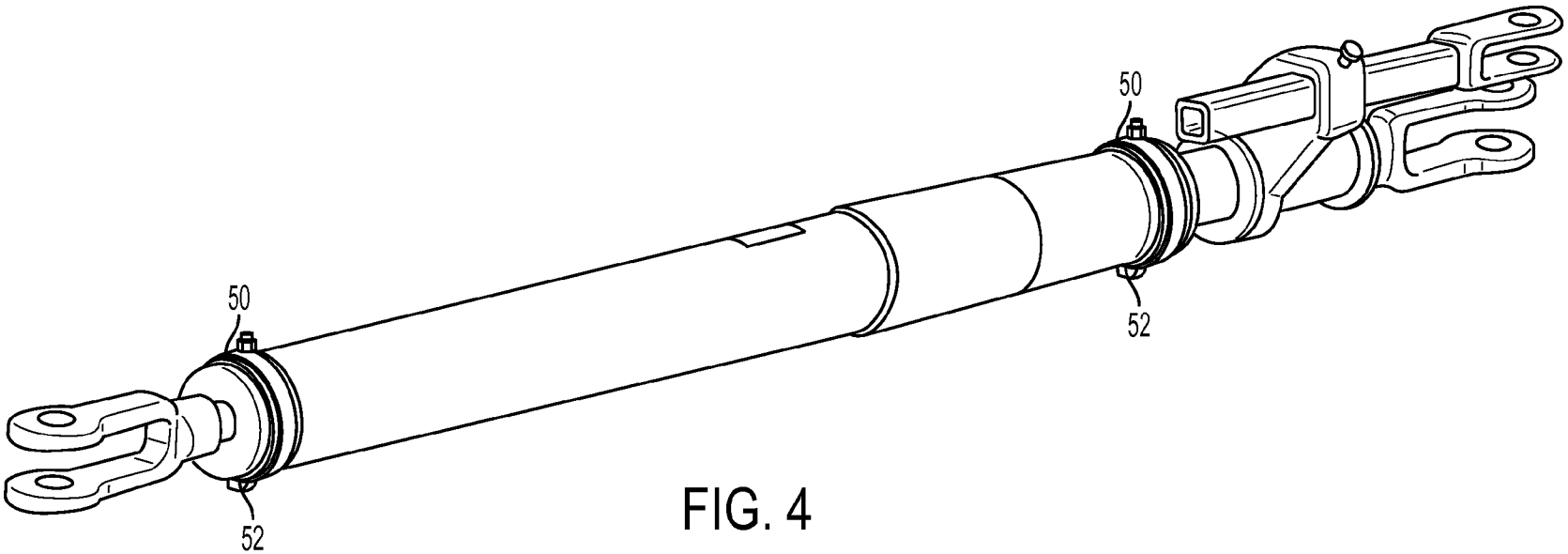
FIG. 4 is a perspective view of another embodiment of a slack adjuster according to the present invention.
Figure 5:
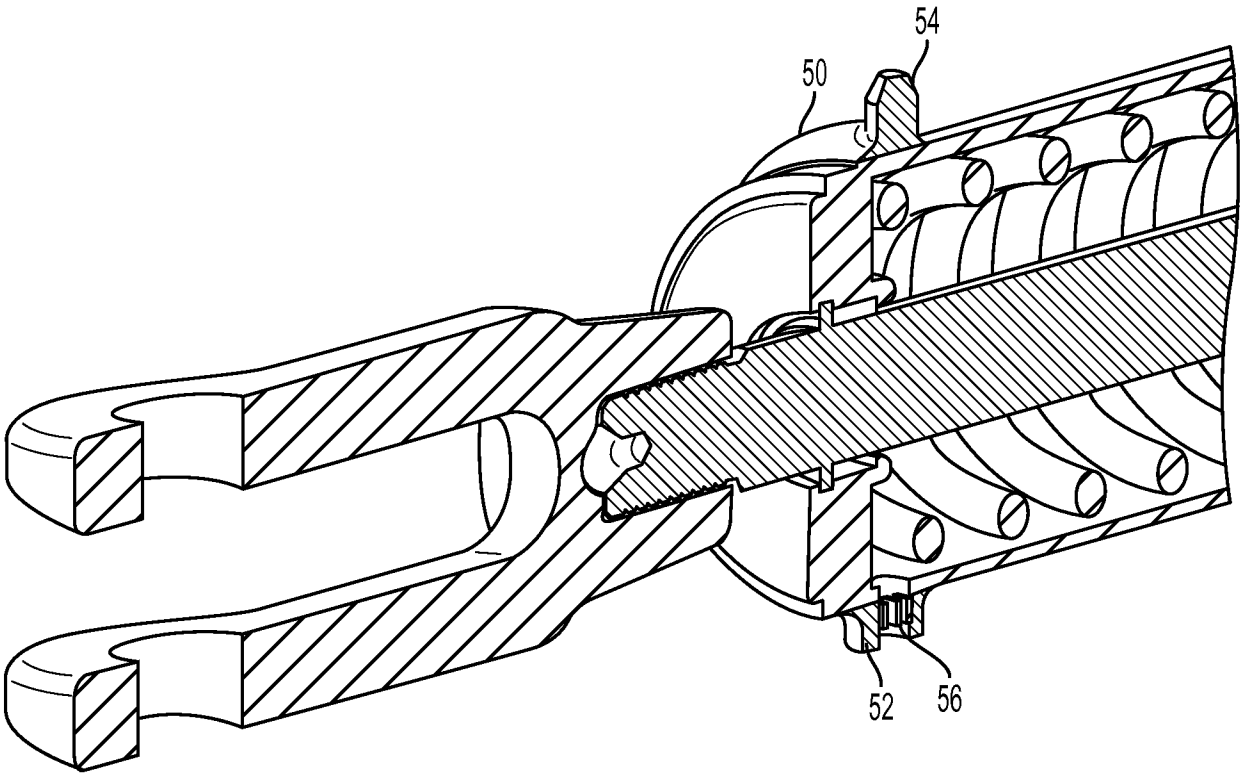
FIG. 5 is a longitudinal cross-section of one portion of the slack adjuster of FIG. 4.

Referring to FIG. 4, the sleeve of slack adjuster 10 may be configured as a resilient ring 50 positioned over the exposed end of spring housing 12 or overtravel housing 14, or both. Ring 50 includes a drain hole 52 formed therein. Ring 50 is positioned so that drain hole 52 communicates with the lowest of the series of holes 42 and 46 formed in spring housing 12 and overtravel housing 14, respectively, while the rest of ring 50 seals the remaining holes 42 and 46. As seen in FIG. 5, ring 50 may include a grip tab 54 that extends radially outwardly from ring 50 so that a user may more easily install, position, or reposition ring 50. Drain hole 52 of ring 50 may further include a wasp excluder 56 that allows for drainage of fluids and gases, but prevents against the ingress of insects and similar contaminants.

Figure 6:
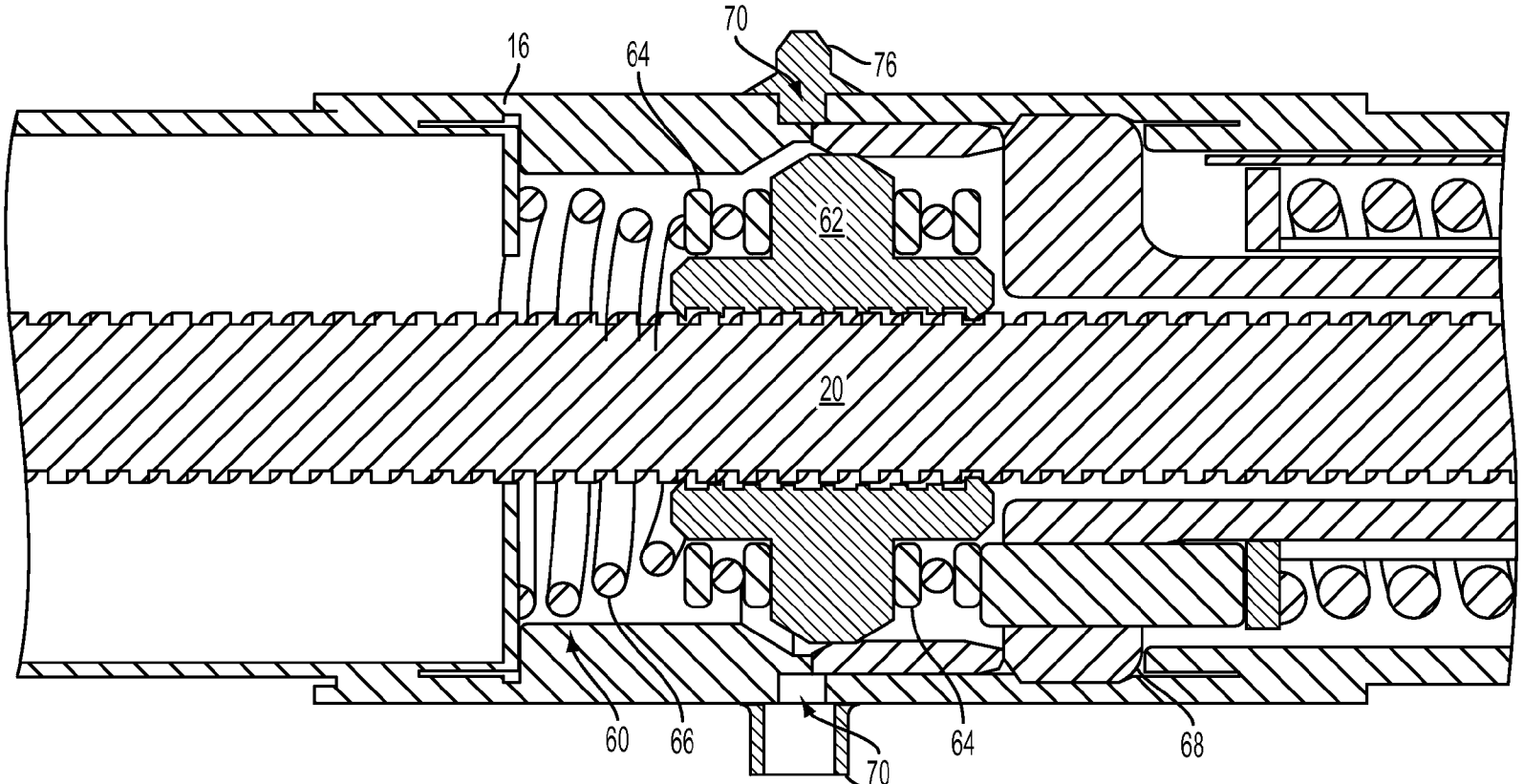
FIG. 6 is a longitudinal cross-section of a coupler body of a slack adjuster according to the present invention.
Figure 7:
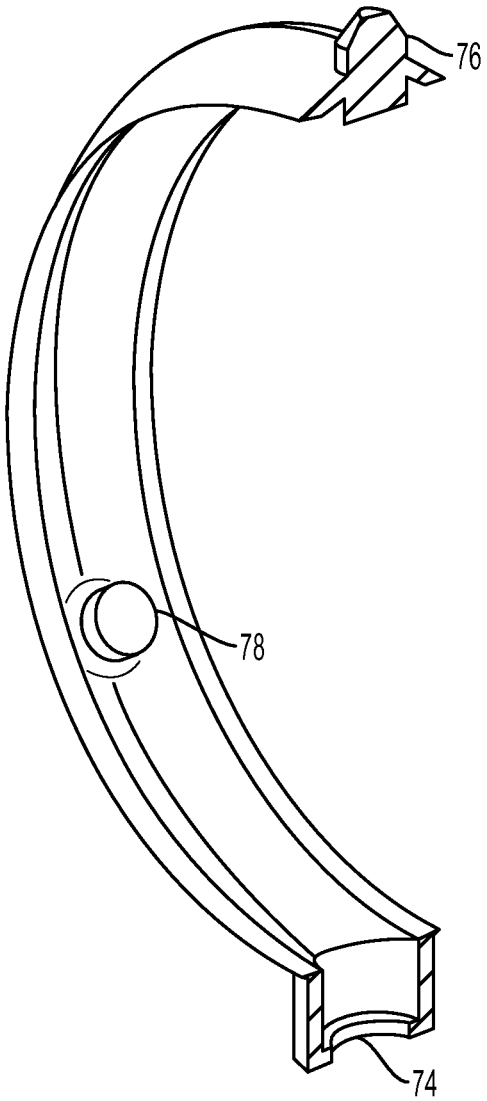
FIG. 7 is a perspective view of a sealing ring for a coupler body according to the present invention.

Slack adjuster 10 is also susceptible to environmental contamination along its intermediate portion and, more particular, in the vicinity of the clutching mechanism that controls the lengthening of slack adjuster 10. As seen in FIGS. 6 and 7, body coupling 16 defines a chamber 60 that housing a clutch 62 and thrust bearings 64 that cooperate with a compression spring 66 and a rod guide 68 to allow slack adjuster 10 to adjust its length under the appropriate conditions. Chamber 60 of body coupling 16 may become infiltrated with environmental contaminants that degrade the various components housed within chamber 60. Body coupling 16 includes a series of circumferentially positioned, equally spaced apart holes 70 such that one of holes 70 will be positioned so that gravity can drain contaminants from chamber 60 of body coupling 16. A sleeve 72 having a single drain hole 74 may be positioned in covering relation to holes 70 such that the lowest hole 70 communicates with drain hole 74. Drain hole 74 may be configured as a wasp excluder. The rest of sleeve 72 seals the remaining holes 70 and may include internally extending nubs 78 to fill non-draining holes 74. Sleeve 72 may additionally include a grip 76 extending radially outwardly and positioned oppositely from drain hole 74 to assist with installation or repositioning of sleeve 72.

What is claimed is:

1. A slack adjuster, comprising:

a spring housing having a first end, a second end, and a series of holes are positioned circumferentially around the first end;

a first rod positioned in the spring housing and extending from a first end of the spring housing;

an overtravel housing having a first end coupled to the second end of the spring housing and a second end;

a second rod positioned in the overtravel housing and extending from the second end of the overtravel housing; and a first sleeve having a slot and being positioned in covering relation to the first end of the spring housing so that the slot is aligned with one of the series of holes and the remaining holes are covered by the sleeve.

2. The slack adjuster of claim 1, wherein a series of holes extend circumferentially around the second end of the overtravel housing.

3. The slack adjuster of claim 2, further comprising a second sleeve having a slot and being positioned in covering relation to the second end of the overtravel housing so that the slot is aligned with one of the series of holes and the remaining holes are covered by the sleeve.

4. The slack adjuster of claim 3, wherein the first sleeve is fixedly attached to the spring housing by a clamp.

5. The slack adjuster of claim 3, wherein the first sleeve is secured to the spring housing by elasticity of the sleeve.

6. The slack adjuster of claim 1, further comprising a coupler interconnecting the spring housing and the overtravel housing and having a chamber therein that houses a clutch.

7. The slack adjuster of claim 6, wherein the coupler includes a series of holes that extend circumferentially around the coupler.

8. The slack adjuster of claim 7, further comprising a third sleeve having a drain that is positioned around the coupler so that the drain aligns with one of the series of holes and covers the remaining holes.

9. The slack adjuster of claim 8, wherein the sleeve includes a tab positioned oppositely from the drain.

10. The slack adjuster of claim 9, wherein the drain includes a wasp excluder.

* * * * *